US009348305B2

(12) United States Patent
Kanai et al.

(10) Patent No.: US 9,348,305 B2
(45) Date of Patent: May 24, 2016

(54) IMAGE FORMING APPARATUS WITH A CARTRIDGE THAT INCLUDES AND IMAGE BEARING MEMBER

(71) Applicant: CANON KABUSHIKI KAISHA, Tokyo (JP)

(72) Inventors: Dai Kanai, Abiko (JP); Takeshi Yasumoto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/524,929

(22) Filed: Oct. 27, 2014

(65) Prior Publication Data

US 2015/0117902 A1 Apr. 30, 2015

(30) Foreign Application Priority Data

Oct. 30, 2013 (JP) ..... 2013-224892

(51) Int. Cl.
*G03G 21/18* (2006.01)

(52) U.S. Cl.
CPC .... *G03G 21/1842* (2013.01); *G03G 2215/0132* (2013.01)

(58) Field of Classification Search
CPC ..... G03G 21/1842; G03G 21/1839
See application file for complete search history.

(56) References Cited

U.S. PATENT DOCUMENTS

2008/0138110 A1* 6/2008 Yoshino et al. ..... 399/114
2009/0297216 A1* 12/2009 Kawai ..... 399/111

FOREIGN PATENT DOCUMENTS

JP 2004-126253 A 4/2004
JP 2007-240661 A 9/2007
JP 2008-170960 A 7/2008

* cited by examiner

*Primary Examiner* — Clayton E Laballe
*Assistant Examiner* — Ruifeng Pu
(74) *Attorney, Agent, or Firm* — Canon U.S.A., Inc. IP Division

(57) ABSTRACT

An image forming apparatus that can prevent a protection cover from being detached from an apparatus main body when the attaching of a process cartridge is completed, with a simple structure includes a biasing portion that can bias the process cartridge. The biasing portion applies biasing force in such a manner that a distal end portion of the protection cover is sandwiched between the apparatus main body and the process cartridge when the process cartridge is attached to the apparatus main body. This structure can prevent the protection cover from being detached from the apparatus main body at a time when the attaching of the process cartridge is completed.

7 Claims, 9 Drawing Sheets

IMAGE FORMING APPARATUS WITH A CARTRIDGE THAT INCLUDES AND IMAGE BEARING MEMBER

BACKGROUND

1. Field of the Invention

The present disclosure relates to an image forming apparatus such as a copying machine, a printer, a facsimile, and a multifunctional peripheral having a plurality of functions of these apparatuses, and more particularly relates to a configuration in which a cartridge that holds an image bearing member such as a photosensitive drum is detachably attached to an apparatus main body.

2. Description of the Related Art

In one conventionally known configuration of an image forming apparatus employing electrophotography and the like, a cartridge having the following feature is used. Specifically, the cartridge includes an image bearing member such as a photosensitive drum and a process unit that forms an image on the image bearing member that can be replaced in an integrated manner. Such a cartridge, which holds the image bearing member and the process unit, includes a cartridge casing and a cover. The cartridge casing has a portion, from which a part of a surface of the image bearing member is exposed, and the cover covers the exposure portion. In this way, with the cover covering the exposure portion, the surface of the image bearing member is prevented from being damaged when the cartridge is not attached to the apparatus main body. An invention has been proposed, in which such a cover is used as a guide for attaching the cartridge to the apparatus main body to improve locatability and facilitate replacement operation (Japanese Patent Application Laid-Open No. 2008-170960).

In the case of the configuration where the cartridge is attached to the apparatus main body as described above, the cartridge is inserted through an opening portion formed in the apparatus main body, and thereby is attached to a predetermined attachment position. If the cover described in Japanese Patent Application Laid-Open No. 2008-170960 is detached from the apparatus main body at the time when the attaching operation of the cartridge has been completed, a user has to support the cover during the operation and thus operability is low. As a possible solution, a latch unit may be provided. However, the latch unit, with which the cover is latched to the main body side in the cartridge attaching operation, requires an additional operation of releasing the latching of the latch unit in detaching the cover from the main body.

SUMMARY

The present disclosure is directed to a configuration that can prevent a cover from being detached from an apparatus main body when the attaching of a cartridge is completed.

According to an aspect disclosed herein, there is provided an image forming apparatus including a cartridge including at least an image bearing member and a cartridge casing configured to hold the image bearing member and provided with a portion from which a part of a surface of the image bearing member is exposed, a cover detachably attached to the cartridge casing and configured to cover the exposure portion in a state of being attached to the cartridge casing, an opening portion into which the cartridge can be inserted in a first direction, the opening portion being provided to an image forming apparatus main body, a restriction portion configured to fit with a distal end portion of the cover, at a time when the cartridge is inserted into the image forming apparatus main body, so as to restrict a movement of the cover in the first direction, and a biasing portion configured to bias the cartridge in such a manner that when the cartridge is attached, biasing force is applied so that the distal end portion of the cover is held between the image forming apparatus main body and the cartridge.

Further features of the present invention will become apparent from the following description of exemplary embodiments with reference to the attached drawings.

DESCRIPTION OF THE EMBODIMENTS

Figure 1:
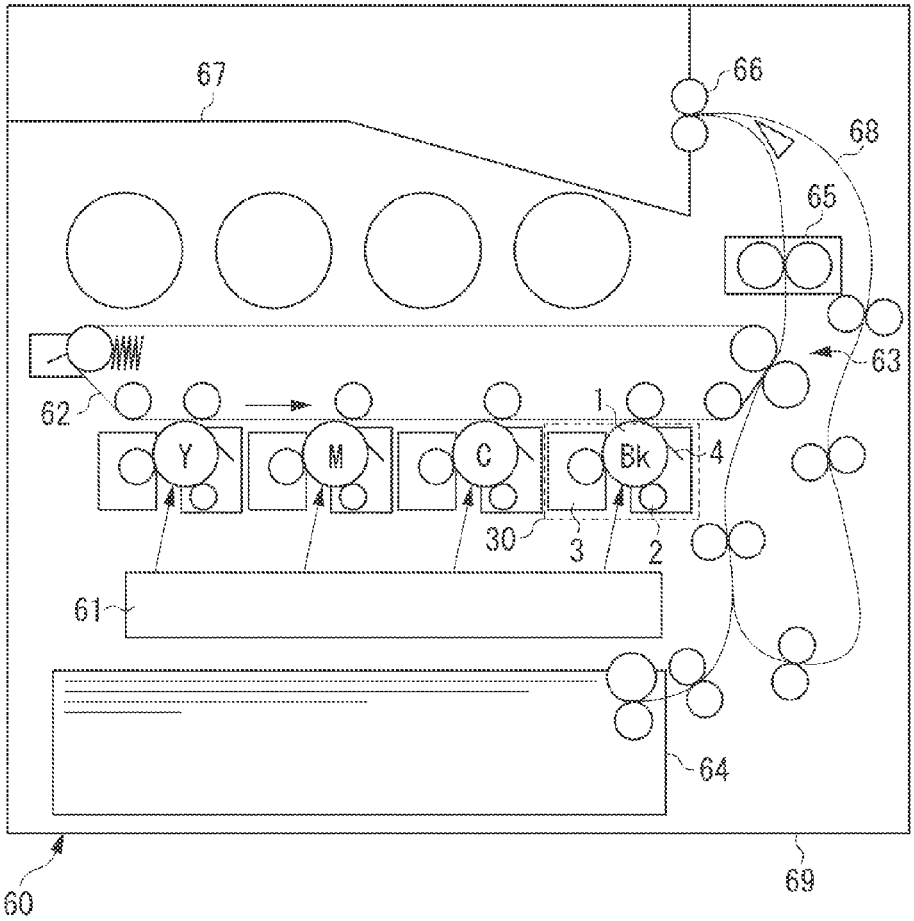
FIG. 1 is a schematic cross-sectional configuration view of an image forming apparatus according to an exemplary embodiment.

Various exemplary embodiments, features, and aspects of the invention will be described in detail below with reference to the drawings (FIGS. 1 to 9).

First, a schematic configuration of an image forming apparatus of the present exemplary embodiment will be described by referring to FIG. 1.

[Image Forming Apparatus]

An image forming apparatus 60 has a so-called tandem type configuration, in which process cartridges 30 of respective colors of yellow (Y), magenta (M), cyan (C), and black (Bk) are arranged along a rotation direction of a belt 62 serving as an intermediate transfer member. The process cartridge 30 of each color forms a toner image of a corresponding color as described later. The toner images of the respective colors are sequentially primarily-transferred onto the intermediate transfer belt 62. Thus, a full color toner image is formed on the intermediate transfer belt 62. The full color toner image on the intermediate transfer belt 62 is transferred onto a recording material (a sheet member such as paper or an overhead projector (OHP) sheet) conveyed from a cassette 64, at a secondary transfer unit 63. The toner image is heated and pressed at a fixing device 65, and is fixed on the recording material. The recording material with the fixed toner image is discharged onto a discharge tray 67 through a discharge unit 66. When duplex printing is performed, the recording material is conveyed again to the secondary transfer unit 63 through a duplex conveyance path 68.

[Process Cartridge]

Figure 2:
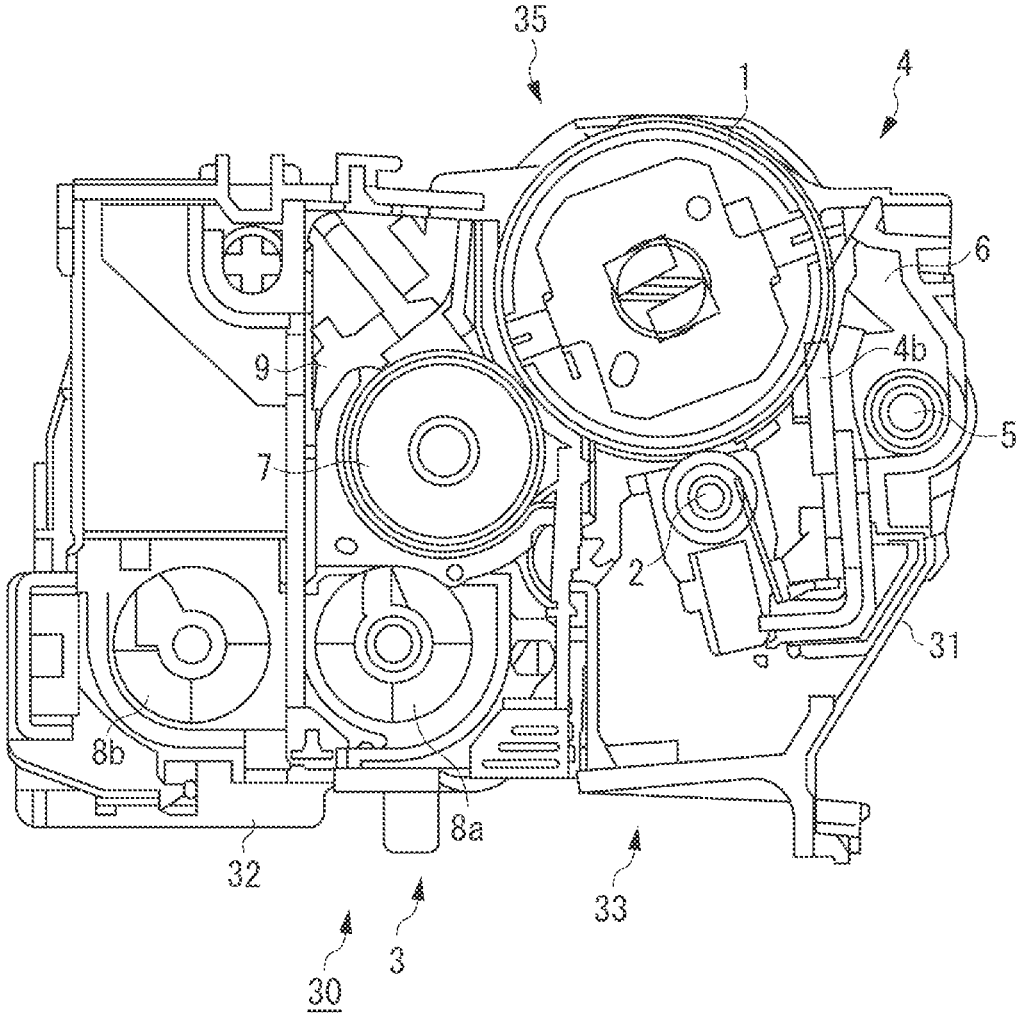
FIG. 2 is a cross-sectional view of a process cartridge according to the exemplary embodiment.

Next, a schematic configuration of the process cartridge 30 of each color is described by referring to FIG. 1 and FIG. 2. The process cartridges 30 of the respective colors have basically the same configuration. The process cartridge 30 includes at least a photosensitive drum (photosensitive member) 1 serving as an image bearing member and a cartridge casing 31 that holds the photosensitive drum 1. The process cartridge 30 is detachably attached to an apparatus main body 69 of the image forming apparatus 60. As described later, the process cartridge 30 has a detachable a protection cover 10 (FIG. 4) that covers an exposure portion 35 from which a part of a surface of the photosensitive drum 1 is exposed.

The process cartridge 30 of the present exemplary embodiment includes the photosensitive drum 1, and further includes, as a process unit for forming an image on the photosensitive drum 1, a charging device 2, a cleaner device 4, and a developing device 3. The process cartridge 30, which is an all-in-one cartridge even including the developing device 3 according to the present exemplary embodiment, may also be a cartridge including no developing device 3. The process cartridges 30 are attached to and detached from the apparatus main body 69 by moving it along the longitudinal direction (first direction) of the photosensitive drum 1.

The process cartridge 30 is described more in detail. As illustrated in FIG. 2, the process cartridge 30 is formed as a combination of a photosensitive device 33 and the developing device 3. The photosensitive device 33 includes the photosensitive drum 1 rotatably supported by the cartridge casing 31, the charging device (charging roller) 2 serving as a charging unit, and the cleaner device 4 serving as a cleaning unit. The developing device 3 includes stirring conveyance screws 8*a* and 8*b* rotatably supported by a developer container 32, a regulation blade 9, and a development sleeve 7.

[Image Forming Process]

In the image forming apparatus 60 to which the process cartridge 30 is attached, a toner image is formed in the following manner. When the process cartridge 30 is attached to a predetermined attachment position of the apparatus main body 69, the photosensitive drum 1, exposed in the exposure portion 35, faces the intermediate transfer belt 62 as illustrated in FIG. 1. In this state, the charging device 2 charges the surface of the drivingly rotated photosensitive drum 1 to a predetermined electrical potential. Then, the charged surface of the photosensitive drum 1 is irradiated with laser light or light emitting diode (LED) light from an exposure device 61 (FIG. 1) in accordance with image information of each color, whereby an electrostatic latent image is formed. The electrostatic latent image on the photosensitive drum 1 is developed as an image with toner of the corresponding color by the developing device 3.

The developing device 3 has the developer container 32 containing a two-component developer including a magnetic carrier and non-magnetic toner. The two-component developer is stirred and conveyed by the stirring conveyance screws 8*a* and 8*b*, whereby the carrier and the toner are charged. The developer including the thus charged carrier and toner is carried and conveyed by the drivingly rotated development sleeve 7 incorporating a magnet, while the thickness is desirably regulated by the regulation blade 9. Thus, the developer is conveyed to an area facing the photosensitive drum 1. Then, a predetermined developing bias is applied between the development sleeve 7 and the photosensitive drum 1, whereby the electrostatic latent image on the photosensitive drum 1 is visualized by the toner.

The process cartridges 30 of the respective colors perform the image forming process described above in parallel. The visualized toner images are sequentially transferred onto the intermediate transfer belt 62 in an overlapping manner with the leading edges aligned, whereby the full color toner image is formed. The toner remaining on the surface of the photosensitive drum 1 after the transferring, is scraped off by a cleaning blade 4*b* of the cleaner device 4, and conveyed to an unillustrated toner collecting container by a cleaner conveyance screw 5 provided in a cleaner collection space 6.

[Process Cartridge Positioning]

Figure 3A:
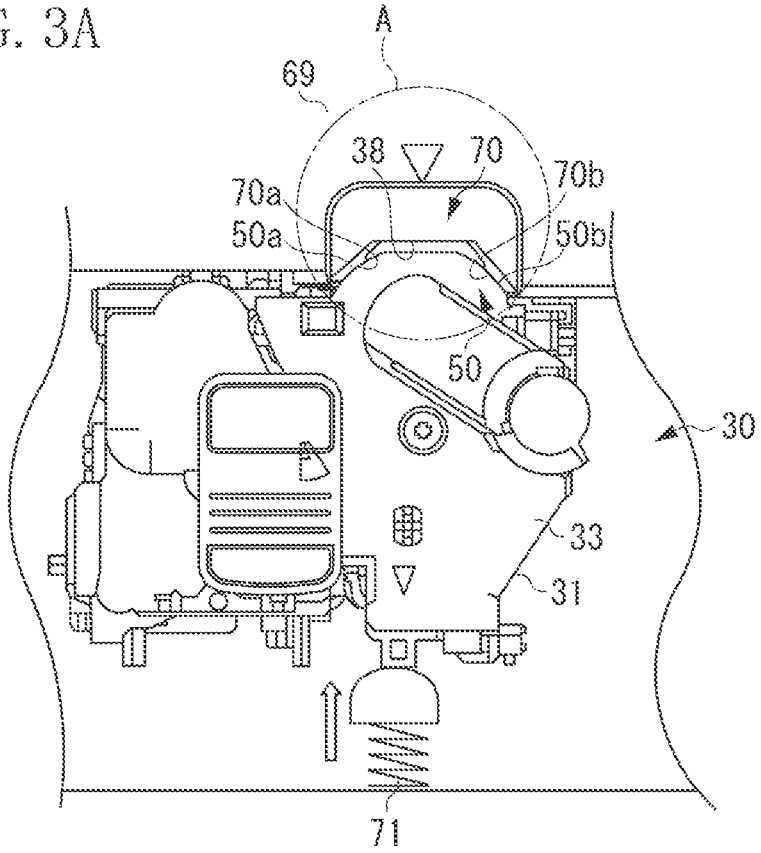
FIGS. 3A and 3B are respectively a front view of a positioning configuration of the process cartridge, and an enlarged view of a section A in FIG. 3A.
Figure 3B:
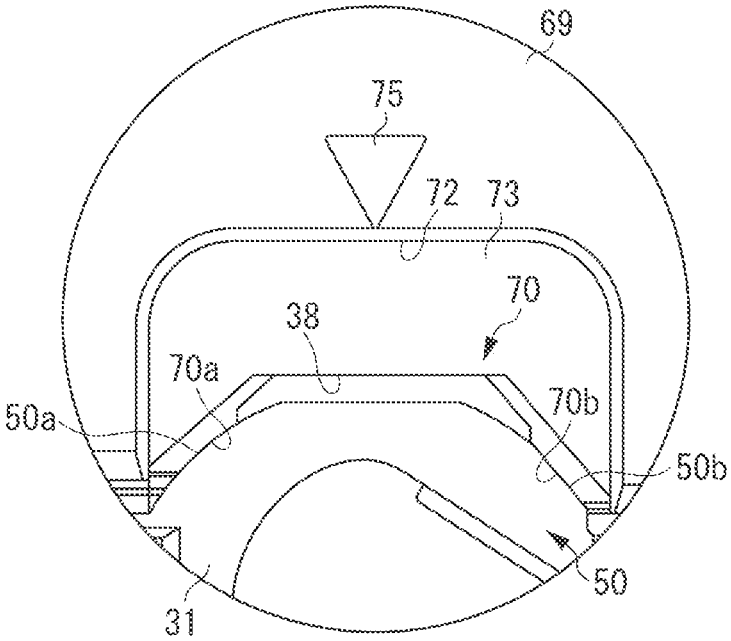

Next, a configuration of positioning the process cartridge 30 on the apparatus main body 69 will be described by referring to FIG. 3. The process cartridge 30 is positioned on the apparatus main body 69 in the following manner at the position where the process cartridge 30 is attached to the apparatus main body 69. The apparatus main body 69 includes a positioning portion 70 that positions the process cartridge 30 in a second direction (upper direction in the present exemplary embodiment) orthogonal to the first direction in which the process cartridge 30 is inserted into the apparatus main body 69. The cartridge casing 31 includes a portion 50 to be positioned that can contact the positioning portion 70 at the position where the process cartridge 30 is attached to the apparatus main body 69. Furthermore, the apparatus main body 69 is provided with a biasing portion 71 including a compression spring that biases the cartridge casing 31, at the attachment position, in the second direction (upper direction). The biasing portion 71 biases the cartridge casing 31 at the attachment position in the upper direction, whereby the portion 50 to be positioned contacts the positioning portion 70. Thus, the process cartridge 30 is positioned on the apparatus main body 69 in the upper and lower direction.

In the present exemplary embodiment, the positioned portion 50 of the cartridge casing 31 has an arc shape and is coaxial to a bearing portion that rotatably supports the photosensitive drum 1. The positioned portion 50 is formed to protrude beyond the outer circumference surface of the photosensitive drum 1 in the second direction (upper direction). Specifically, the positioned portion 50 is made of resin, and includes arc portions 50*a* and 50*b* at two places on both sides of a rotational axis of the photosensitive drum 1. The positioning portion 70 of the apparatus main body 69 is disposed adjacent to an opening portion 38 into which the process cartridge 30 can be inserted in the first direction, and is made of metal. Specifically, the positioning portion 70 is a part of a frame member including a metal plate forming the apparatus main body 69, and is formed by punching out the metal plate portion of the frame member. In the illustrated example, the positioning portion 70 includes portions 70*a* and 70*b* inclined in such a manner that the lower the positions of parts of surfaces, which respectively contact the arc portions 50*a* and 50*b* of the positioned portion 50 at the two places, are located, the more the inclined portions 70*a* and 70*b* are separated from each other.

The process cartridge 30 is positioned in the upper and lower direction when the arc portions 50*a* and 50*b* of the positioned unit 50 at the two places respectively contact the inclined portions 70*a* and 70*b* of the positioning portion 70 at the two places. The configuration of the image forming apparatus 60 requires the high position accuracy and high form accuracy of the positioning portion 70. Thus, in the present exemplary embodiment, the positioning portion 70 is formed by punching out the metal plate portion of the frame member.

This is because the positioning portion 70 formed by bending the metal plate for example is lower in position accuracy and form accuracy than the positioning portion 70 formed by the punching.

[Relationship Between Protection Cover and Process Cartridge]

Next, a relationship between the protection cover 10 and the process cartridge 30 will be described by referring to FIG. 4. As described above, the process cartridge 30 includes the cartridge casing 31 and the protection cover 10. The protection cover 10 is detachably attached to the cartridge casing 31. The protection cover 10 attached to the cartridge casing 31 covers the exposure portion 35 (FIG. 2) of the cartridge casing 31 from which a part of the surface of the photosensitive drum 1 is exposed.

Figure 4A:
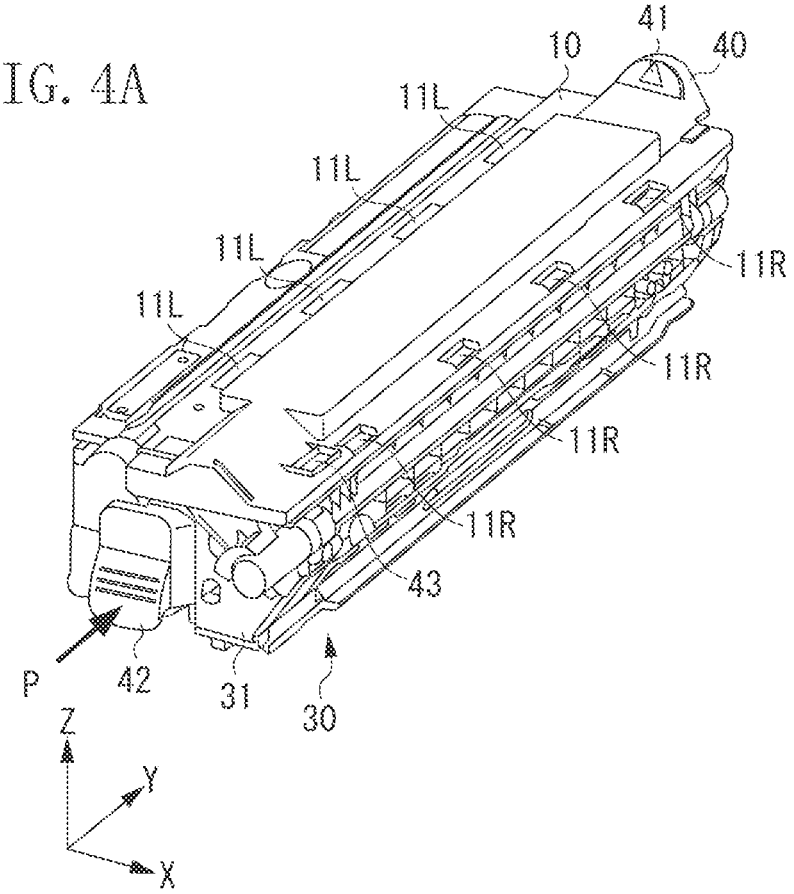
FIGS. 4A and 4B are respectively a perspective view and a partially omitted cross-sectional view of the process cartridge where a protection cover is attached.

As described later, the cartridge casing 31 is relatively moved in the first direction with respect to the protection cover 10 such that the exposure portion 35 is exposed, in accordance with an operation of inserting the process cartridge 30 into the apparatus main body 69 in the first direction. Thus, the protection cover 10 includes a plurality of engaging claws 11R and 11L which are portions for guiding the cartridge casing 31 in the first direction in accordance with the insertion operation of the process cartridge 30. As illustrated in FIG. 4A, the engaging claws 11R and 11L are respectively disposed on both sides of the photosensitive drum 1 in the circumference direction, and the plurality of engaging claws 11R and 11L are provided along the first direction.

Figure 4B:
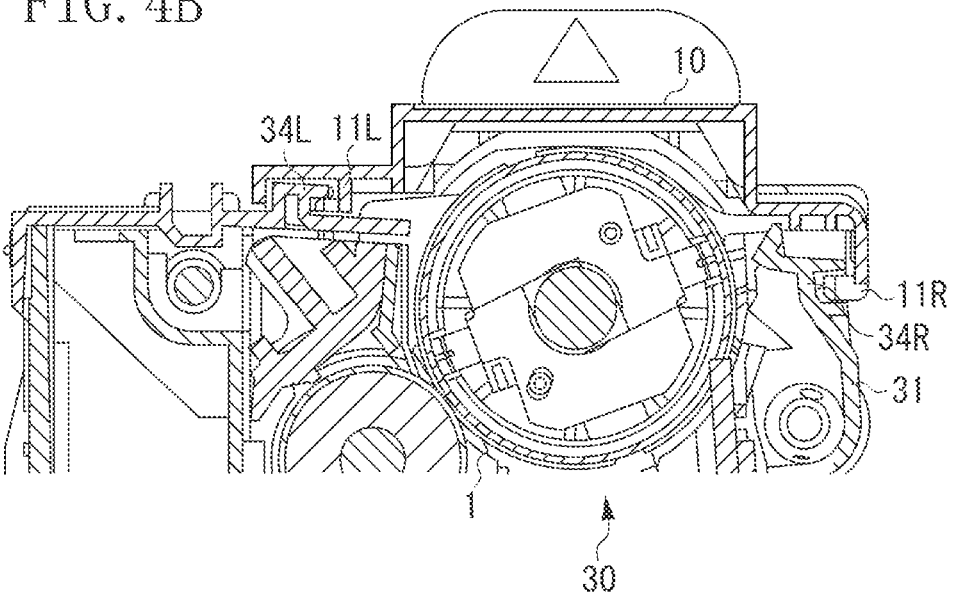

On the cartridge casing 31, engaging grooves 34R and 34L that respectively engage with the engaging claws 11R and 11L are formed along the first direction as illustrated in FIG. 4B. The cartridge casing 31 is guided in the first direction relative to the protection cover 10 with the engaging claws 11R and 11L engaged with the engaging grooves 34R and 34L.

As illustrated in FIG. 4A, the protection cover 10 is provided with a latch portion 43 of a resin spring having a hook shape. The latch portion 43 latches onto a part of the cartridge casing 31 when the protection cover 10 is covering the exposure portion 35 of the cartridge casing 31 (attached state). The latching of the latch portion 43 onto the part of the cartridge casing 31 is released when the cartridge casing 31 is relatively moved in the first direction. Thus, as described later, when the process cartridge 30 is pressed in an insertion direction while the movement of the protection cover 10 is restricted, force equal to or higher than a predetermined level is applied to the latch portion 43, whereby the resin spring of the latch portion 43 is bent and the latching of the hook is released.

[Attaching of Process Cartridge to Apparatus Main Body]

Figure 5:
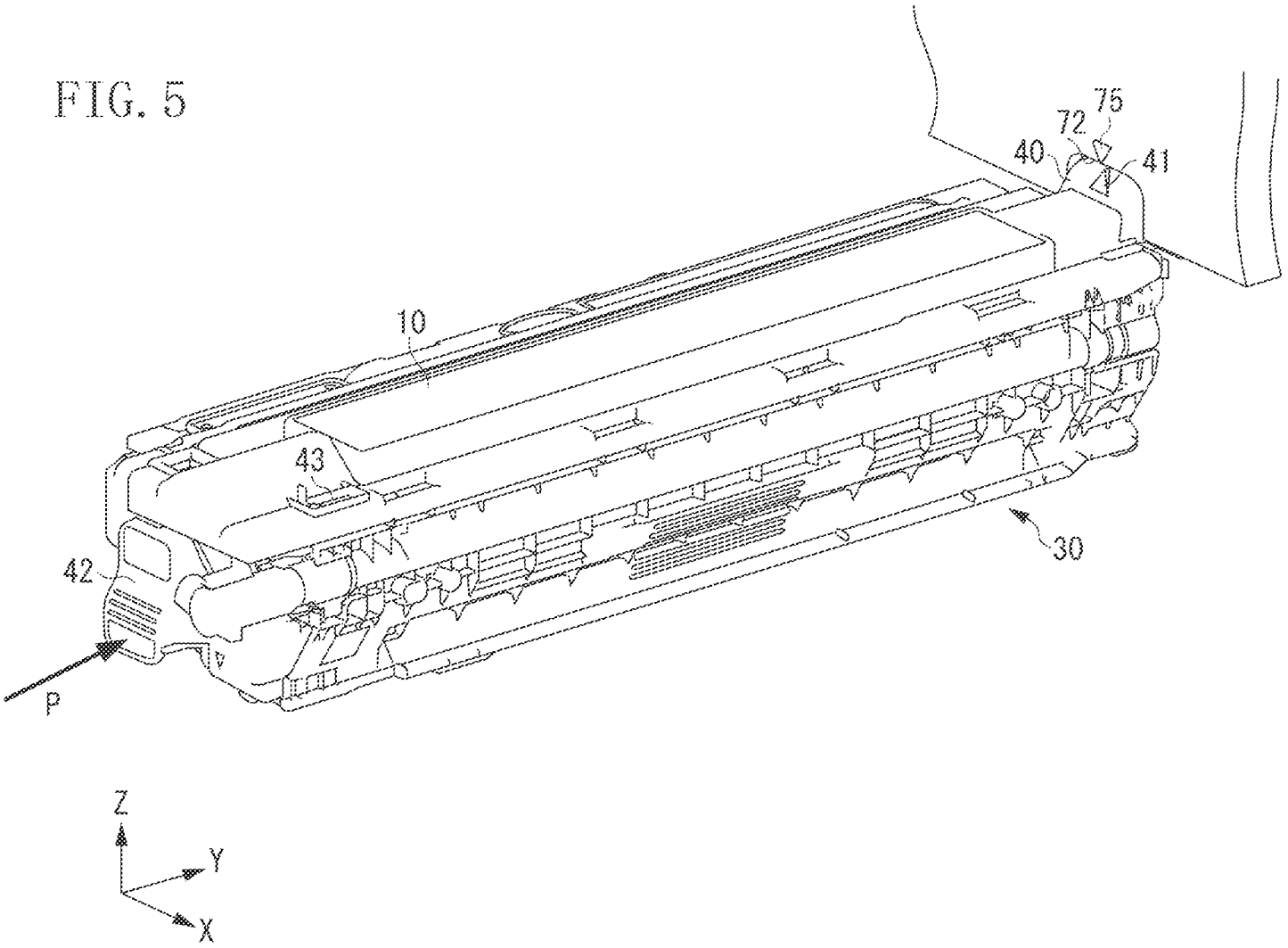
FIG. 5 is a perspective view illustrating a state where the process cartridge is started to be inserted into an apparatus main body.
Figure 6A:
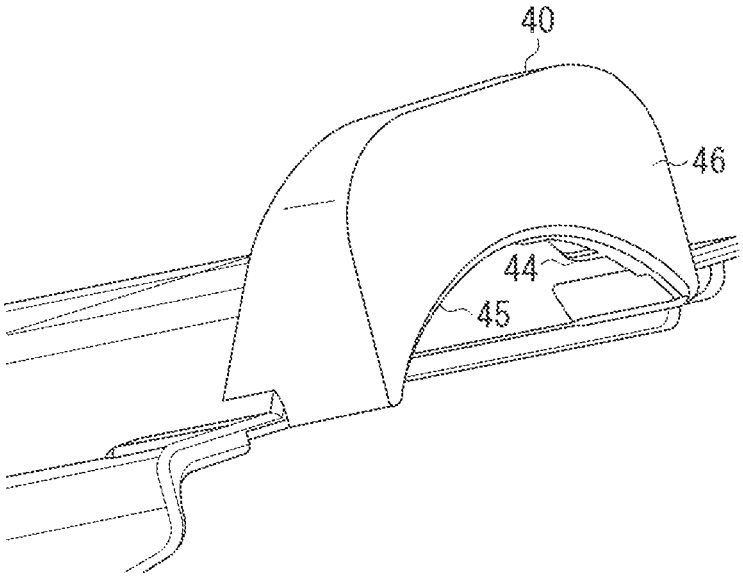
FIGS. 6A and 6B are respectively a perspective view of a portion around a positioning portion of the apparatus main body, and a perspective view of a portion around a distal end portion of the cover on an insertion side.

Next, a configuration and an operation for attaching the process cartridge 30 to the apparatus main body 69 will be described by referring to FIGS. 5 to 9. As illustrated in FIG. 5, when the process cartridge 30 is attached to the apparatus main body 69, an abutting portion (distal end portion) 40 formed at a distal end of the protection cover 10 in the insertion direction (first direction) is fit in an insertion positioning portion 72 serving as a restriction portion of the apparatus main body 69, whereby the insertion position is determined. As shown in FIG. 6A, the abutting portion 40 is formed at the distal end of the protection cover 10 and protrudes toward the side opposite to the side where the process cartridge 30 is provided. A distal end surface 46 of the abutting portion 40 is a flat surface orthogonal to the first direction. A contact portion 45 is formed at an inner side of the abutting portion 40 on the side where the process cartridge 30 is provided. As described later, the contact portion 45 contacts the positioned portion 50 of the cartridge casing 31 when the process cartridge 30 reaches the attachment position in the apparatus main body 69.

Figure 6B:
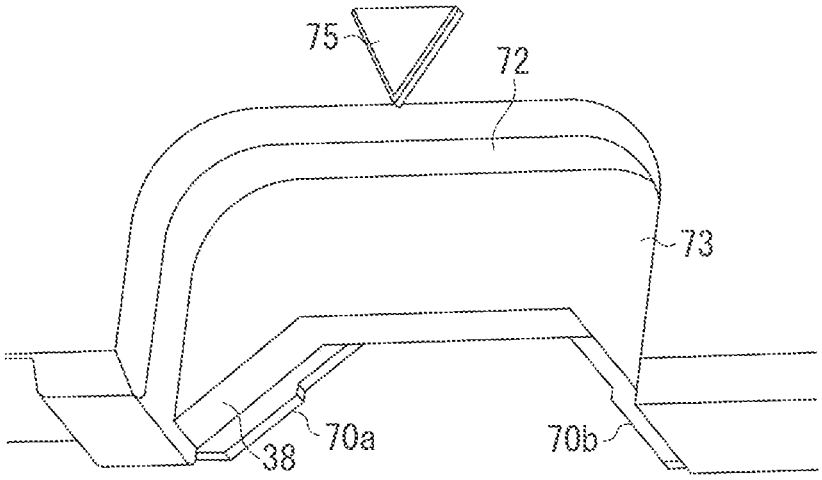

As shown in FIG. 6B, the insertion positioning portion 72 is formed as a recess in an insertion direction around the opening portion 38 of the apparatus main body 69. A bottom surface of the insertion positioning portion 72 is a wall portion 73. Side walls of the insertion positioning portion 72 have a shape corresponding to the outer shape of the abutting portion 40 of the protection cover 10. Thus, the side walls guide the entrance of the abutting portion 40 and fit the abutting portion 40. When the process cartridge 30 is inserted in the first direction, the wall portion 73 contacts the distal end surface 46 of the abutting portion 40 of a part of the protection cover 10, and restricts the movement of the protection cover 10 in the first direction.

A mark 41 is provided in the abutting portion 40 of the protection cover 10. A mark 75 is provided adjacent to the insertion positioning portion 72 of the apparatus main body 69. The marks are used by a user, a service man, or the like at the time of inserting the process cartridge 30 into the apparatus main body 69. Specifically, as illustrated in FIG. 5, the abutting portion 40 is inserted into the insertion positioning portion 72 with the mark 41 of the abutting portion 40 aligned with the mark 75 of the apparatus main body 69. Then, in the thus positioned state, a handle 42 of the process cartridge 30 is pressed in a direction of an arrow P (insertion direction), whereby the distal end surface 46 of the abutting portion 40 contacts the wall portion 73 of the insertion positioning portion 72. In this state, positioning is performed to insert the process cartridge 30 into the apparatus main body 69.

In this state, the process cartridge 30 is further pressed in the insertion direction. Here, further movement of the protection cover 10 is restricted with the distal end surface 46 of the protection cover 10 being in contact with the wall portion 73. Thus, the process cartridge 30 is relatively moved with respect to the protection cover 10, with the latch portion 43 of the protection cover 10 released. Accordingly, the process cartridge 30 is inserted into the apparatus main body 69 with the protection cover 10 remaining at the same position. Here, the engaging claws 11R and 11L of the protection cover 10 and the engaging grooves 34R and 34L of the cartridge casing 31 engage with each other at a plurality of portions. Thereby, the protection cover 10 guides the process cartridge 30 in a Y axis direction (insertion direction) while restricting the movement of the process cartridge 30 in a Z direction (upper and lower direction).

Figure 7A:
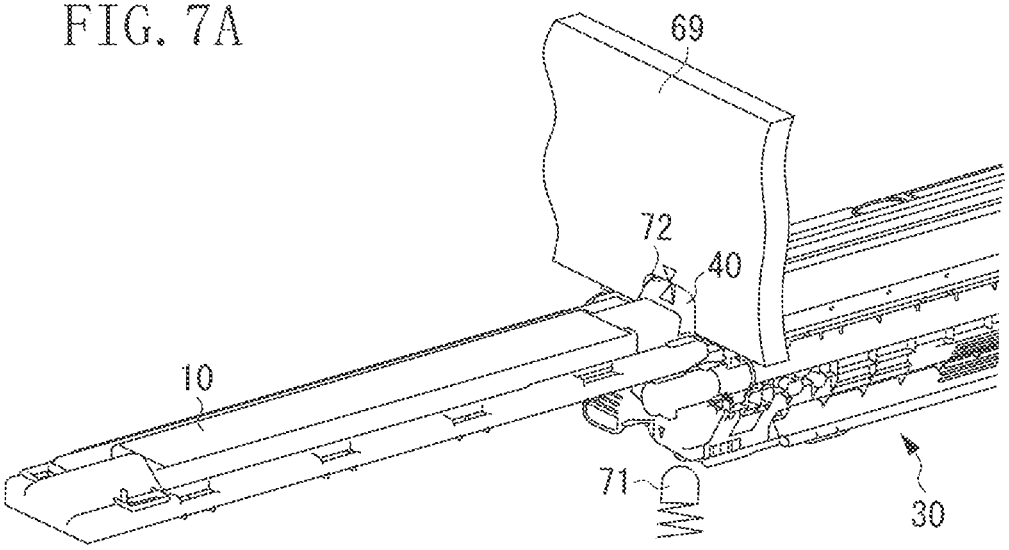
FIGS. 7A and 7B are respectively a perspective view illustrating a state where the process cartridge reaches an attachment position, and a positional relationship between the positioning portion and a portion to be positioned in this state.
Figure 7B:
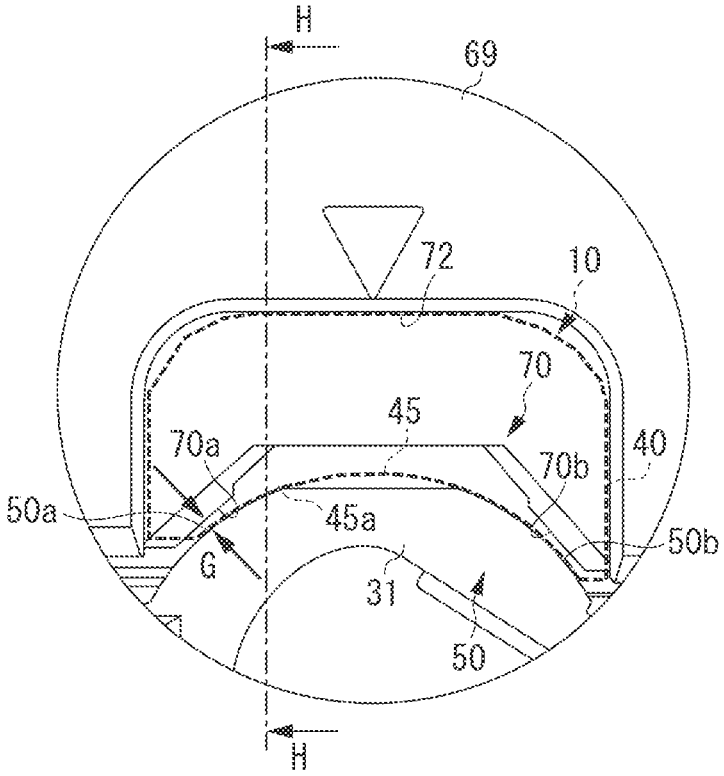

As illustrated in FIG. 7A, when the process cartridge 30 reaches the attachment position in the apparatus main body 69, the abutting portion 40 of the protection cover 10 is sandwiched between the cartridge casing 31 and the apparatus main body 69. The contact portion 45 is formed in the abutting portion 40. As shown in FIG. 7B, the contact portion 45 contacts the portion 50 to be positioned of the cartridge casing 31 when the process cartridge 30 reaches the attachment portion. The contact portion 45 is made of resin similar to the portion 50 to be positioned, and has a contact surface 45*a*, to be in contact with the portion 50 to be positioned. The contact surface 45*a* is disposed closer to the portion 50 to be positioned than the positioning portion 70 of the apparatus main body 69. Thus, in this state, as shown in FIG. 7B, a gap G is provided between the portion 50 to be positioned and the positioning portion 70, whereby the portion 50 to be positioned and the positioning portion 70 do not contact each other.

Figure 8A:
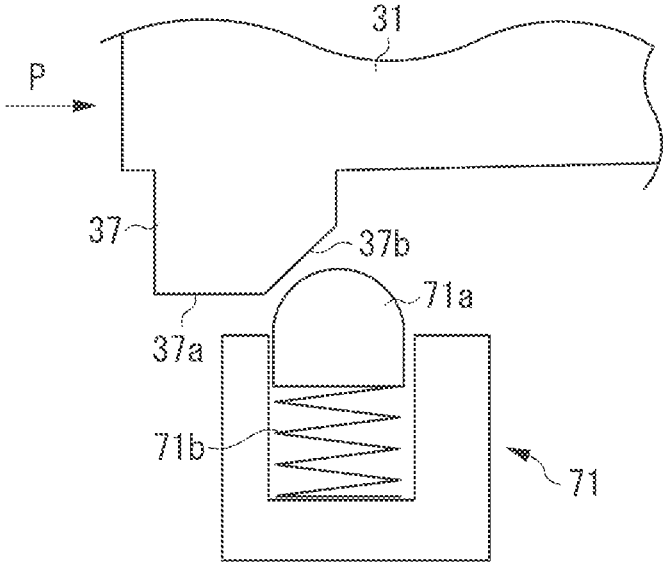
FIGS. 8A and 8B are diagrams of a configuration for biasing the process cartridge respectively illustrating a state before the biasing, and a state during the biasing.
Figure 8B:
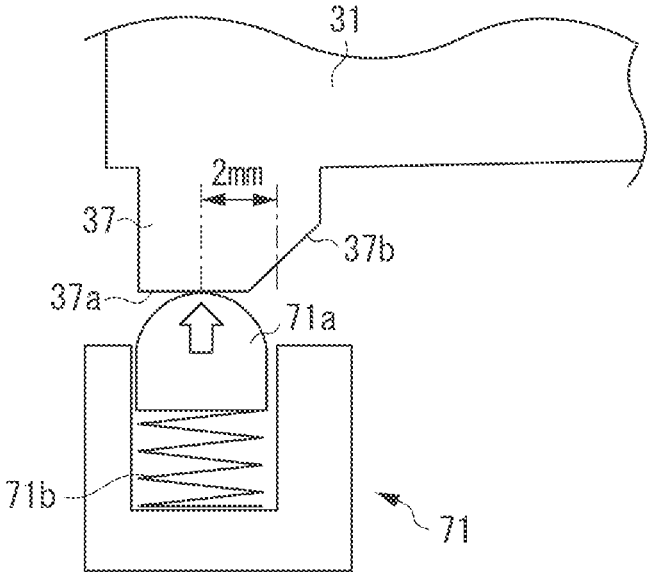

As illustrated in FIG. 8, when the process cartridge 30 reaches the attachment position, the biasing portion 71 applies force to the cartridge casing 31. Specifically, a protruding portion 37 protruding downward is formed on a lower surface of the cartridge casing 31 on the upstream side in the insertion direction. The protruding portion 37 includes, on the lower surface, a contact surface 37*a* and an inclined surface 37*b* on the downstream side of the contact surface 37*a* in the insertion direction. The farther on the downstream side of the inclined surface 37*b*, the more upward the inclined surface 37*b* is inclined. When the process cartridge 30 is inserted in the direction of the arrow P, an abutting portion 71*a* of a biasing portion 71 provided to the apparatus main body 69 contacts the inclined surface 37*b*, and thus the compression spring 71*b* of the biasing portion 71 is elastically compressed. When the process cartridge 30 is further inserted, as illustrated in FIG. 8B, the abutting portion 71*a* contacts the contact surface 37*a* of the protruding portion 37. Thus, the cartridge casing 31 is biased upward via the protruding portion 37 by the biasing portion 71.

In the present exemplary embodiment, the biasing by the biasing portion 71 starts immediately before the process cartridge 30 reaches the attachment position. The force applied by the biasing portion 71 serves as insertion load against the force by which the user inserts the process cartridge 30 into the apparatus main body 69. Thus, the biasing force is preferably produced at a position immediately before the attachment position. In the present exemplary embodiment, the positioning variation between the contact surface 37*a* of the protruding portion 37 and the biasing portion 71, and the positioning variation of the insertion positioning portion 72 on the apparatus main body 69 side for positioning the process cartridge 30 in the insertion direction are taken into consideration. Thus, the biasing portion 71 applies the force to the cartridge main body 31 at a position apart from the attachment position by a predetermined distance. In the present exemplary embodiment, the predetermined distance from a position where the abutting portion 71*a* of the biasing portion 71 starts to contact the inclined surface 37*b* of the protruding portion 37 to the attachment portion is 2 mm. The positioning variation, in the insertion direction, between the protruding portion 37 and the biasing portion 71 is ±0.6 mm from the predetermined position. Thus, the predetermined distance is determined to ensure a safety factor equal to or higher than 200% of the variation.

Figure 9:
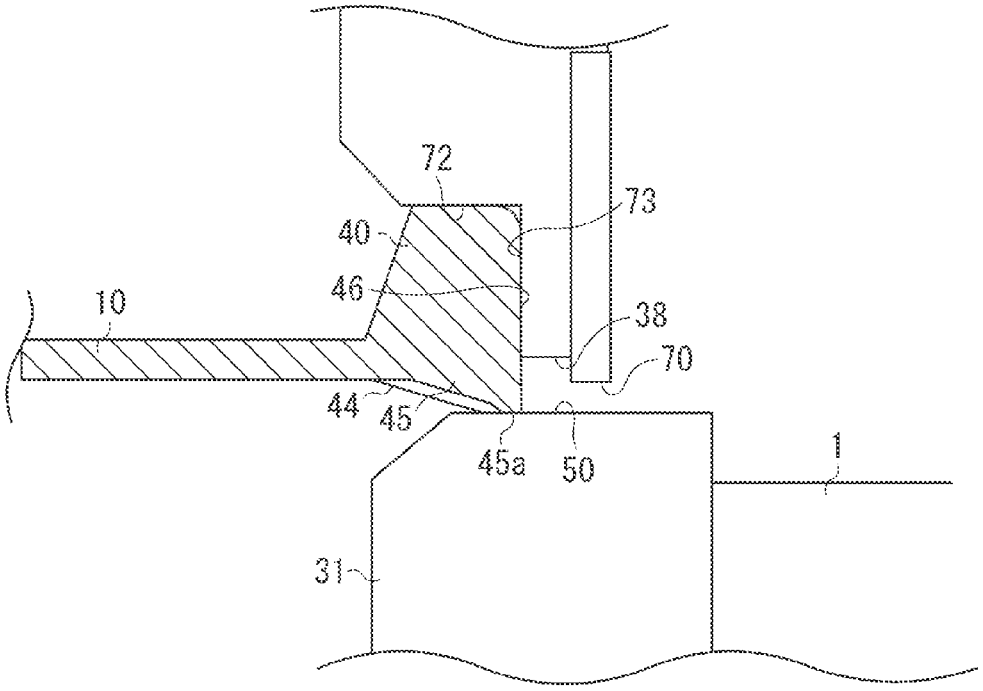
FIG. 9 is a cross-sectional view, taken along a line H-H in FIG. 7B, schematically illustrating a positional relationship between a contact portion of the cover and the positioning portion and the portion to be positioned in the state where the process cartridge reaches the attachment position.

As described above, the contact portion 45 formed in the abutting portion 40 of the protection cover 10 contacts the portion 50 to be positioned of the cartridge casing 31. Thus, the portion 50 to be positioned is guided toward the contact portion 45 when the process cartridge 30 is inserted. For this purpose, in the protection cover 10, a positioned portion guide portion 44 is formed at a portion of the contact portion 45 on the upstream side in the first direction as illustrated in FIG. 9. The positioned portion guide portion 44 is made of resin, similar to the contact portion 45, and the farther on the upstream side the positioned portion guide portion 44, the more upward the positioned portion guide portion 44 is inclined. The positioned portion guide portion 44 contacts, in a sliding manner, the portion 50 to be positioned to guide the portion 50 to be positioned toward the contact portion 45, when the cartridge casing 31 is relatively moved in the first direction in accordance with the insertion operation of the process cartridge 30.

When the process cartridge 30 has reached the attachment position, the portion 50 to be positioned of the cartridge casing 31 contacts the contact portion 45 formed in the abutting portion 40 of the protection cover 10. The biasing portion 71 biases the cartridge casing 31, whereby the abutting portion 40 of the distal end portion of the protection cover 10 is sandwiched between the cartridge casing 31 and the apparatus main body 69.

As a result, as illustrated in FIG. 7B and FIG. 9, the contact portion 45 of the protection cover 10 serves as a spacer between the positioning portion 70 made of the metal plate and the positioned portion 50. Thus, the gap G is secured between the positioning portion 70 and the positioned portion 50 when the process cartridge 30 reaches the attachment position in the apparatus main body 69. Thus, the positioning portion 70 and the portion 50 to be positioned are prevented from rubbing against each other while being in pressure contact with each other.

The protection cover 10 is detached from the cartridge casing 31 that has reached the attachment position, and thus the portion 50 to be positioned, biased by the biasing portion 71, contacts the positioning portion 70. Thus, the process cartridge 30 is positioned relative to the apparatus main body 69 in the upper and lower direction (second direction), whereby the attaching of the processing cartridge 30 to the apparatus main body 69 is completed.

The abutting portion (distal end portion) 40 of the protection cover 10 before being detached from the cartridge casing 31 is held between the cartridge casing 31 and the apparatus main body 69 by the force applied by the biasing portion 71. In other words, the biasing portion 71 can bias the process cartridge 30 in the following manner. Specifically, the biasing force can be applied in such a manner that the distal end portion of the protection cover 10 is sandwiched between the apparatus main body 69 and the process cartridge 30 at a time when the process cartridge 30 is attached. Thus, the posture of the protection cover 10 does not change from when the insertion of the process cartridge 30 is started. The user or the like pulls off the thus held protection cover 10, in a direction opposite to the insertion direction, whereby the protection cover 10 is detached from the cartridge casing 31. Thus, the process cartridge 30 is positioned relative to the apparatus main body 69 in the second direction. Here, the protection cover 10 is held only by the force applied by the biasing portion 71, and thus can be easily detached by grasping any portion.

As described above, the positioning portion 50 of the cartridge casing 31 and the contact portion 45 of the protection cover 10 contact each other when the process cartridge 30 reaches the attachment position. Thus, in this state, the positioning portion 70 of the apparatus main body 69 and the portion 50 to be positioned of the cartridge casing 31 can be prevented from rubbing against each other. The contact portion 45 and the poisoned portion guide portion 44 of the protection cover 10, as well as the portion 50 to be positioned are all made of resin. Thus, the rubbing therebetween during the insertion operation is less likely to scrape the portion 50 to be positioned or become a load in the insertion operation.

Thus, in the present exemplary embodiment, the load in the insertion operation of the process cartridge 30 can be reduced, and the deviation of the attachment position of the apparatus main body 69 as a result of scraping of the portion 50 to be positioned can be reduced. Thus, the user can more easily install and replace the process cartridge 30.

In particular, in the present exemplary embodiment, when the process cartridge 30 is attached to the apparatus main body 69, the distal end portion of the protection cover 10 is sandwiched between the apparatus main body 69 and the process cartridge 30 by the force applied by the biasing portion 71. Thus, with a simple configuration, the protection cover 10 can be prevented from being detached from the apparatus main body 69 when the attaching of the process cartridge 30 is completed.

OTHER EMBODIMENT

In the above description, the protection cover 10 is positioned relative to the apparatus main body 69 through fitting the distal end portion in the insertion direction (abutting portion 40) of the protection cover 10, in the recess portion (insertion positioning portion 72) of the apparatus main body 69. Alternatively, for example, the positioning can be achieved by engaging a positioning shaft on the apparatus main body 69 side with a hole on the protection cover 10 side.

In the above description, the contact portion 45 and the positioned portion guide portion 44 of the protection cover 10 are made of resin that contact the portion 50 to be positioned of the process cartridge 30. Alternatively, since the present invention aims at reducing the load in the insertion operation of the process cartridge 30, the contact portion 45 and the positioned portion guide portion 44 may also be made of a galvanized steel plate for example.

In the present invention, when a cartridge is attached, a distal end portion of a cover is sandwiched between an apparatus main body and a process cartridge by force applied by a biasing portion. Thus, with a simple configuration, the cover can be prevented from being detached from the apparatus main body when the attaching of the cartridge is completed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-224892 filed Oct. 30, 2013, which is hereby incorporated by reference herein in its entirety.

What is claimed is:

1. An image forming apparatus comprising:

a cartridge including at least an image bearing member, configured to be detachably mounted on an image forming apparatus;

a housing configured to house the cartridge;

an opening portion, provided on the housing, from which the cartridge is inserted toward the housing;

a contact portion configured to contact with a cover so as to slidably move the cartridge with respect to the cover in inserting the cartridge that is provided with the cover to protect the image bearing member in the housing;

a positioning portion configured to determine, by contacting with the cartridge, a position of the cartridge relative to the housing in a substantially orthogonal direction with respect to an inserting direction for inserting the cartridge into the housing;

a biasing portion configured to bias the cartridge toward the positioning portion; and a moving mechanism configured to move the biasing portion so that the biasing portion biases the cartridge according to the motion of inserting the cartridge into the housing, wherein the cartridge is separated from the positioning portion when the biasing portion biases the cartridge in a state that the cover is in contact with the contact portion, and when the cover is removed from the contact portion, position of the cartridge is set in the orthogonal direction of the contact portion by the cartridge contacting with the positioning portion.

2. The image forming apparatus according to claim 1, wherein the positioning portion is made of metal, and a portion to be positioned of the cartridge, and the contact portion, are made of resin.

3. The image forming apparatus according to claim 1, wherein the cartridge includes an insertion guide portion configured to be guided by the cover in the inserting direction in accordance with an insertion operation of the cartridge.

4. The image forming apparatus according to claim 1, wherein the cartridge includes a latched portion configured to be latched onto the cover in a state where the cover is attached to the cartridge and to have the latching released at a time when the cartridge casing is relatively moved in the inserting direction.

5. The image forming apparatus according to claim 1, wherein the cartridge includes the image bearing member, a charging unit configured to charge the surface of the image bearing member, and a cleaning unit configured to clean the surface of the image bearing member.

6. The image forming apparatus according to claim 1, wherein the cartridge includes a developing unit configured to develop an electrostatic latent image formed on the surface of the image bearing member.

7. The image forming apparatus according to claim 1, wherein, in a vertical direction, the positioning portion is arranged in an upper position to the image bearing member and the image bearing member is arranged in an upper position the biasing portion.

* * * * *